US010524055B2

(12) United States Patent
Kaetel

(10) Patent No.: US 10,524,055 B2
(45) Date of Patent: Dec. 31, 2019

(54) EARPHONE AND METHOD FOR PRODUCING AN EARPHONE

(71) Applicant: Kaetel Systems GmbH, Munich (DE)

(72) Inventor: Klaus Kaetel, Munich (DE)

(73) Assignee: Kaetel Systems GmbH, Munich (DE)

( * ) Notice: Subject to any disclaimer, the term of this patent is extended or adjusted under 35 U.S.C. 154(b) by 0 days.

(21) Appl. No.: 15/136,485

(22) Filed: Apr. 22, 2016

(65) Prior Publication Data

US 2016/0241963 A1 Aug. 18, 2016

Related U.S. Application Data

(63) Continuation of application No. PCT/EP2014/072881, filed on Oct. 24, 2014.

(30) Foreign Application Priority Data

Oct. 25, 2013 (DE) ..... 10 2013 221 752

(51) Int. Cl.

| | |
|---|---|
| ***H04R 1/08*** | (2006.01) |
| ***H04R 9/08*** | (2006.01) |
| ***H04R 11/04*** | (2006.01) |
| ***H04R 17/02*** | (2006.01) |
| ***H04R 7/14*** | (2006.01) |
| ***H04R 1/10*** | (2006.01) |
| ***H04R 5/033*** | (2006.01) |

(Continued)

(52) U.S. Cl.

CPC ..... *H04R 7/14* (2013.01); *H04R 1/1075* (2013.01); *H04R 5/033* (2013.01); *H04R 7/04* (2013.01); *H04R 7/18* (2013.01); *H04R 9/063* (2013.01); *H04R 1/1016* (2013.01); *H04R 5/02* (2013.01); *H04R 2201/105* (2013.01); *H04R 2205/022* (2013.01); *H04R 2231/003* (2013.01)

(58) Field of Classification Search

CPC . H04R 1/08; H04R 9/08; H04R 11/04; H04R 17/02; H04R 21/02; H04R 9/00; H04R 9/025; H04R 9/027; H04R 7/00

USPC ..... 381/176, 398, 418–419, 429

See application file for complete search history.

(56) References Cited

U.S. PATENT DOCUMENTS 4,020,299 A * 4/1977 Garner ..... H04R 7/02 181/166

7,706,561 B2 4/2010 Wilmink et al.

(Continued)

FOREIGN PATENT DOCUMENTS

AT 234171 B 6/1964

CH 452608 A 3/1968

(Continued)

*Primary Examiner* — Suhan Ni

(74) *Attorney, Agent, or Firm* — Michael A. Glenn; Perkins Coie LLP

(57) ABSTRACT

An earphone has a membrane mounted on a membrane carrier and arranged between a top space and a bottom space; a membrane actuator implemented to deflect the membrane in dependence on a control signal; a housing where the membrane carrier, the membrane and the membrane actuator are arranged, wherein the housing has a sound exit, wherein the membrane carrier has openings, and wherein the membrane has holes, and wherein the openings and the holes connect the top space and the bottom space to each another, such that gas can move through the openings and holes between the top space and the bottom space.

10 Claims, 6 Drawing Sheets

(51) Int. Cl.

| | |
|---|---|
| ***H04R 7/04*** | (2006.01) |
| ***H04R 7/18*** | (2006.01) |
| ***H04R 9/06*** | (2006.01) |
| *H04R 5/02* | (2006.01) |

(56) References Cited

U.S. PATENT DOCUMENTS

| | | | | |
|---|---|---|---|---|
| 7,839,052 | B2 * | 11/2010 | Wu | B81B 3/0072 181/171 |
| 8,345,897 | B2 * | 1/2013 | Takahashi | H04R 9/025 381/176 |
| 8,750,554 | B2 * | 6/2014 | Sakamoto | H04R 7/12 181/173 |
| 2002/0136425 | A1 * | 9/2002 | Warren | H04R 11/02 381/423 |

FOREIGN PATENT DOCUMENTS

| | | | |
|---|---|---|---|
| DE | 1762264 | A1 | 4/1970 |
| DE | 3700594 | A1 | 7/1987 |
| DE | 19819452 | C1 | 1/2000 |
| DE | 202006008315 | U1 | 10/2006 |
| WO | 2006128768 | A1 | 12/2006 |
| WO | 2012130985 | A1 | 10/2012 |

* cited by examiner

EARPHONE AND METHOD FOR PRODUCING AN EARPHONE

CROSS-REFERENCE TO RELATED APPLICATIONS

This application is a continuation of copending International Application No. PCT/EP2014/072881, filed Oct. 24, 2014, which is incorporated herein by reference in its entirety, and additionally claims priority from German Application No. 10 2013 221 752.8, filed Oct. 25, 2013, which is also incorporated herein by reference in its entirety.

BACKGROUND OF THE INVENTION

The present invention relates to earphones and in particular to earphones for reproducing a complete audio scene.

Typically, audio scenes are recorded by using a set of microphones. Each microphone outputs a microphone signal. In an orchestra, for example, 25 microphones are used. Then, the audio engineer carries out a mixture of the 25 microphone output signals, typically into a standardized format, such as a stereo format, a 5.1 format, a 7.1 format, a 7.2 format etc. In a stereo format, the audio engineer or an automatic mixing process generates two stereo channels. For a 5.1 format, mixing results in five channels and one subwoofer channel. Analogously, for example in a 7.2 format, mixing results in seven channels and two subwoofer channels.

When the audio scene is reproduced in a reproduction environment, the mixing result is applied to electrodynamic loudspeakers. In a stereo reproduction system, two loudspeakers exist, wherein the first loudspeaker receives the first stereo channel and the second loudspeaker receives the second stereo channel. In a 7.2 reproduction system, seven loudspeakers exist at predetermined positions and two subwoofers. The seven channels are applied to the respective loudspeakers and the two subwoofer channels are applied to the respective subwoofers.

Above that, there is also headphones reproduction, wherein different approaches exist. Typically, two channels are generated for headphones reproduction, namely a left stereo channel and a right stereo channel, wherein the left stereo channel is reproduced via the left earpiece of the headphones and the right stereo channel via the right earpiece of the headphones. Alternatively, in order to improve spatial perception, binaural processings are performed, wherein by using so-called head-related transfer functions (HRTFs) or binaural room impulse responses (BRIRs), the stereo channels are preprocessed, such that the headphones user does not only have a stereo experience but also a spatial experience.

The usage of a single microphone system on the detection side and a single converter array in headphones on the reproduction side typically neglect the true nature of sound sources. For example, acoustic musical instruments and the human voice are to be differentiated according to how sound is generated and what the emission characteristics are like. Trumpets, trombones, horns and other wind instruments, for example, have strongly directed sound emission. Thus, these instruments emit in an advantageous direction and thus have a high directivity or high quality.

On the other hand, violins, cellos, double basses, guitars, grand pianos, pianos, gongs and similar acoustic musical instruments have a comparatively small directivity or a respective small emission quality factor Q. These instruments use so-called acoustic short circuits when sound is generated. An acoustic short circuit is generated by communication between front and rear of the respective vibrating area or surface.

The human voice generates an average Q factor. Here, the air connection between mouth and nose effects an acoustic short circuit.

String or bow instruments, xylophones, triangles, etc. generate, for example, sound energy in a frequency range up to 100 kHz and additionally have low emission directivity or a low emission quality factor. In particular the tone of a xylophone and a triangle is clearly identifiable, despite their low sound energy and despite their low quality factor, even within a loud orchestra.

Thus, it becomes clear that sound generation by acoustic instruments or other instruments and also by the human voice differs greatly.

When sound energy is generated, air molecules, for example diatomic or triatomic gas molecules are stimulated. There are three different mechanisms that are responsible for this stimulation. In this regard, reference is made to the German patent DE 198 19 452 C1. These three different mechanisms are illustrated in FIG. 5. The first mechanism is translation. Translation describes the linear movement of the air molecules or atoms with respect to the centroid of the molecule, shown at 70 in FIG. 5. The second mechanism is rotation where air molecules or atoms rotate around the centroid of the respective molecule, again indicated by 70. The third mechanism is vibration where the atoms or molecules reciprocate in a specific direction with respect to the centroid 70 of the molecules.

Thus, the sound energy generated by acoustic musical instruments and by the human voice consists of individual mixing ratios of translation, rotation and vibration.

Typically, merely translation is considered. In other words, this means that rotation and vibration are normally not considered during the complete description of the sound energy, which results in significantly perceptible sound quality losses.

On the other hand, the complete sound intensity is defined by a sum of the intensities originating from translation, rotation and vibration.

Above that, different sound sources have different sound emission characteristics. The sound emission generated by musical instruments and generated by the voice generates a sound field, and this sound field reaches the listener via two paths. The first path is the direct sound, where the direct sound portion of the sound field allows exact positioning of the sound source. The second component is the spatial emission. Sound energy emitted in all spatial directions generates a specific sound of instruments or a group of instruments, since this spatial emission cooperates with the room by attenuations, reflections, etc. A specific connection between direct sound and spatially emitted sound is characteristic of all musical instruments and human voice.

WO 2012/130985 A1 discloses a method and an apparatus for detecting and reproducing an audio scene, where sound is detected with a first directivity by microphones arranged between the audio scene and the potential listener. Further, a second detection signal is detected with lower directivity by microphones arranged above or on the side of the audio scene. These two detection signals are separately mixed and processed but are not combined. On the reproduction side, the signals are then output by loudspeaker systems, such as a loudspeaker system in a standard format, where a loudspeaker system comprising both omnidirectional loudspeakers and directional loudspeakers is arranged at each predetermined position of the standard format.

FIG. 6 shows one earphone as disclosed, for example, in U.S. Pat. No. 7,706,561 B2. The earphone in FIG. 6 comprises a housing 60, a membrane 61, an actuator 62, a sound exit opening 63 as well as terminals 64. The actuator 62 comprises a magnetic drive as illustrated schematically by coil assemblies 65. By exciting the coil assembly 65, the actuator 62 which is illustrated in a curved manner, moves towards the top or the bottom, as illustrated by arrow 66. Thereby, the membrane is deflected towards the top or bottom by the actuator rod 67, whereby a "soft spot" 68 is illustrated, which is necessitated so that the membrane can move more easily at the position where the actuator rod 67 is mounted. As illustrated in U.S. Pat. No. 7,706,561 B2, this soft spot can, for example, be an area of the membrane 62 filled with a soft material or, as illustrated, an area with thinner membrane material. By deflecting the membrane via the actuator rod 67, the membrane is deflected towards the top or bottom, such that the area above the membrane in the "top space" 69 is vibrated. This vibration will reach the overall sound exit opening 63 of the earphone via an exit opening 70. The earphone shown in FIG. 6 is characterized by a small structure due to the curved actuator. However, it is a disadvantage of this earphone that the sound quality is reduced, since the membrane array with actuator rod generates no air rotation but merely translation/vibration. Thus, the perceived sound is reduced in quality.

SUMMARY

According to an embodiment, an earphone may have: a membrane mounted on a membrane carrier and arranged between a top space and a bottom space; a membrane actuator implemented to deflect the membrane in dependence on a control signal; a housing where the membrane carrier, the membrane and the membrane actuator are arranged, wherein the housing has a sound exit, wherein the membrane carrier has openings, and wherein the membrane has holes, wherein the openings and the holes connect the top space and the bottom space to each other, such that gas can move through the openings and holes between the top space and the bottom space.

According to another embodiment, a method for producing an earphone may have the steps of: providing a membrane with holes and a membrane carrier with openings; placing the membrane, the membrane carrier and the membrane actuator, which is implemented to deflect the membrane in dependence on a control signal, in a housing comprising a sound exit, such that the openings and holes connect a top space above the membrane and a bottom space below the membrane to each other, such that gas can move through the openings and holes between the top space and the bottom space.

The present invention is based on the knowledge that a rotation in an earphone can also be generated by efficient means when holes are introduced into the membrane of the earphone and simultaneously the membrane carrier is provided with openings, such that by a cooperation of the holes in the membrane and the openings in the membrane carrier, air rotation is excited, which can then reach the sound exit.

In particular, openings and holes are arranged such that they connect the top of the membrane and the bottom of the membrane, such that gas, e.g. air, can move through the openings and holes between the top and the bottom. Thereby, gas/air rotation is generated by the movement of the membrane, which provides an optimum sound experience to the user in addition to translation/rotation.

BRIEF DESCRIPTION OF THE DRAWINGS

Embodiments of the present invention will be discussed below with reference to the accompanying drawings, in which.

DETAILED DESCRIPTION OF THE INVENTION

Figure 1A:
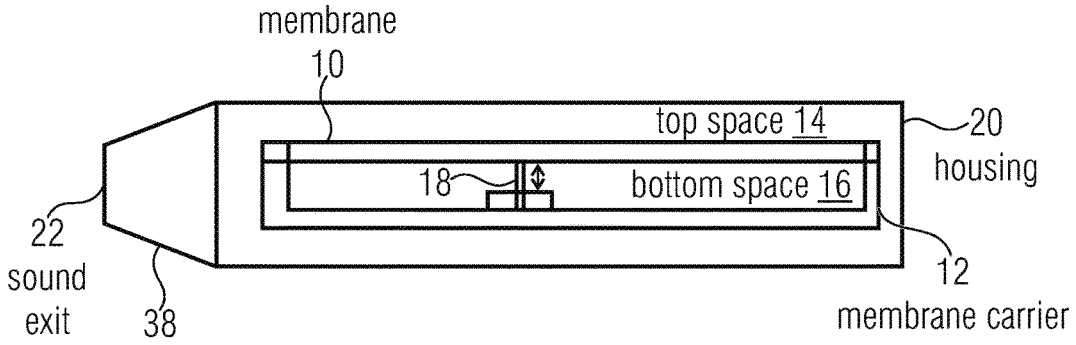
FIG. 1*a* shows a schematic illustration of an earphone.

FIG. 1*a* shows an earphone with a membrane 10 mounted on a membrane carrier 12 and arranged between a top space 14 and a bottom space 16.

Further, a membrane actuator 18 shown schematically in FIG. 1*a* is arranged to deflect the membrane 10 in dependence on a control signal. The membrane actuator can be implemented in different ways, for example like the actuator of FIG. 7 of U.S. Pat. No. 7,706,561. Alternatively, the membrane actuator can be implemented in any known manner in order to deflect the membrane 10 between the top space and the bottom space.

Further, a housing 20 is provided, in which the membrane carrier 12, the membrane 10 and the membrane actuator 18 are arranged, wherein the housing includes a sound exit 22.

Figure 1B:
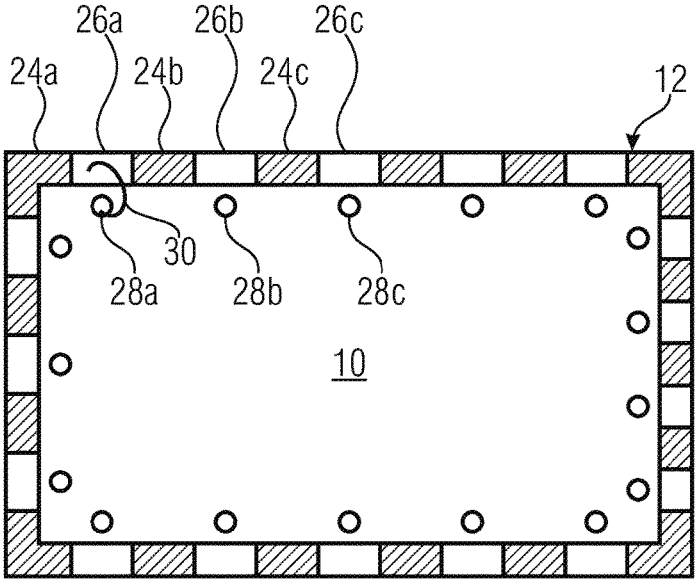
FIG. 1*b* shows a schematic illustration of the membrane with membrane carrier for generating the gas rotation.

FIG. 1*b* shows a detailed illustration of the membrane 10 mounted on the membrane carrier 12. In particular, the membrane is mounted on carrier portions 24*a*, 24*b*, 24*c*, wherein the mounting can take place in any way. Free portions 26*a*, 26*b*, 26*c* where the membrane is not mounted on the membrane carrier lie in between. These free portions 26*a*-26*c* represent openings in the membrane carrier 12. Above that, the membrane 10 comprises holes 28*a*, 28*b*, 28*c*, wherein the holes 28*a*, 28*b*, 28*c* as well as the openings 26*a*, 26*b*, 26*c* in the membrane carrier 12 connect the top and the bottom to each other, i.e. the top space 14 and the bottom space 16, such that gas can move through the openings and holes between the top and the bottom. In particular by a cooperation of the free portion or the opening 26*a*, for example with the hole 28*a* in the membrane, which abut on each other or are arranged adjacent to each other, the gas, i.e. air, is rotated in the space where the membrane is located when the membrane is moved, as illustrated schematically by 30. A respective cooperation also exists between the hole 28*b* and the opening 26*b* or the hole 28*c* and the opening 26*c*, or between each hole and the adjacent opening portions of the carrier 12 that are not specifically indicated by reference numbers.

Figure 2A:
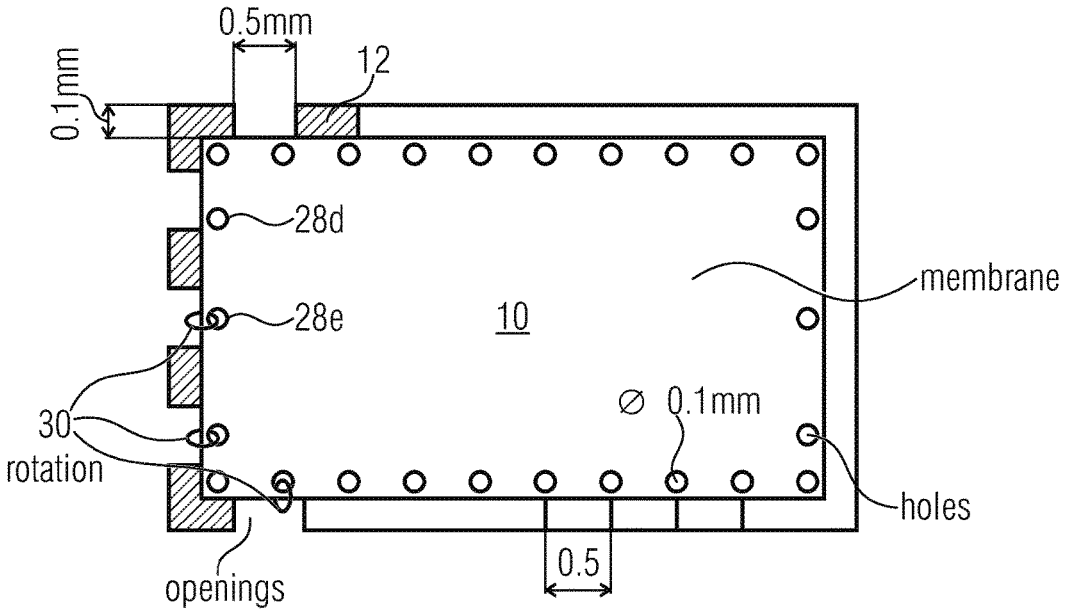
FIG. 2*a* shows a detailed illustration of the membrane carrier and the membrane according to an embodiment of the present invention.

As shown in FIG. 1*b* or also FIG. 2*a*, the membrane 10 is held by the membrane carrier along its periphery. Here, an opening, such as 26*a* in FIG. 1*b*, is arranged between two holding portions 24*a*, 24*b*, such that a portion of the membrane 10 between holding portions 24*a*, 24*b* is not connected to the membrane carrier 12, which is caused by the opening 26*a*. Further, as shown in FIG. 1*b*, a hole is formed in the portion of the membrane arranged beside the opening 26*a*.

Figure 2B:
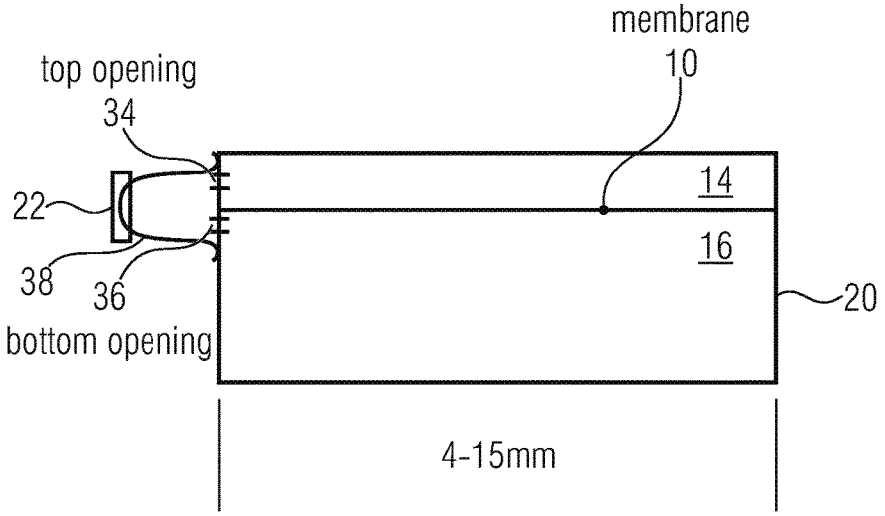
FIG. 2*b* shows a further detailed illustration of the earphone according to an embodiment with top and bottom openings.

In an embodiment of the present invention, shown in detail in FIG. 2*b*, the housing does not only have the top opening 34 shown, for example, in the known earphone in FIG. 7, but also the bottom opening 36 such that not only the top space 14 can communicate with the sound exit 22, but that also the bottom space 16 communicates with the sound exit 22 via the bottom opening 36. Thus, more efficient transmission of rotation effected by the cooperation of holes and openings of the membrane or membrane carrier to the sound exit is obtained, compared to the situation where only the top opening 34 exists.

In an embodiment of the present invention, an opening in the membrane carrier 12 has a length between 0.4 and 0.6 mm and is advantageously, as shown in FIG. 2*a*, 0.5 mm. Further, a hole in the membrane is dimensioned such that same has a length or a diameter between 0.05 and 0.15 mm, wherein 0.1 mm is of advantage.

Above that, it is of advantage to implement the width of the membrane carrier or the openings, as shown in FIG. 2*a*, in a range between 0.05 and 0.1 mm and advantageously at 0.1 mm. Additionally, in the embodiment shown in FIG. 2*a*, a distance between two adjacent openings in the membrane carrier is between 0.4 and 0.6 mm and advantageously 0.5 mm. This distance is advantageously of the same size as the distance between two adjacent holes in the membrane, which is also advantageously 0.05 mm and can be between 0.4 mm and 0.6 mm in other embodiments.

Figure 6:
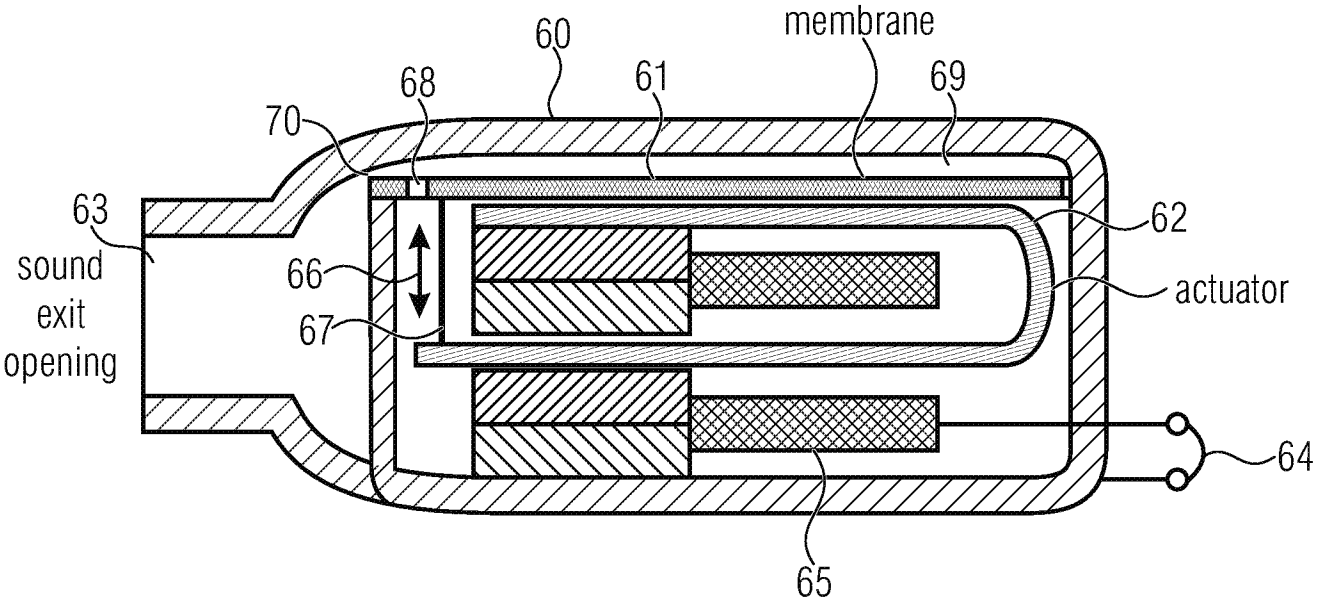
FIGURE 6 (PRIOR ART)
FIG. 6 shows a cross-sectional view of a known earphone.

Above that, in the embodiment shown in FIG. 2*a*, it is obvious that at least two holes of the membrane oppose each opening, such that good rotation 30 can be excited, with high efficiency by two holes and one opening. On the other hand, the illustrated minimum distance of the holes ensures that the membrane does not become unstable due to the many gaps. Depending on the embodiment, a hole/opening combination can also only be provided on one side, for example on the side facing the sound exit 22, while the rest of the membrane suspension can be implemented in a common manner, i.e. without openings or holes, as illustrated, for example, in the known technology described based on FIG. 6.

Alternatively or additionally, however, as illustrated in FIG. 2*a*, the holes can be arranged and distributed evenly along the circumference of the membrane, and the openings can also be arranged evenly along the periphery of the membrane carrier. The membrane can also comprise two or more parallel rows of holes, wherein the most efficient excitation of the rotation, however, is obtained with exactly one row as shown in the figures.

Although FIG. 2*a* shows that two holes oppose one opening, this number can also be different, such that, for example, only a single hole in the membrane or three or more holes oppose one opening, depending on the dimensioning of the carrier and the membrane.

As shown, for example in FIG. 2*b* or FIG. 1*a*, the earphone includes a tapering front portion 38 at the end of which the sound exit is located. This front portion is dimensioned such that the earphone can be introduced, for example, into a human auditory passage.

Depending on the embodiment of the present invention, it is of advantage to significantly increase the frequency response of the sound converter for transmitting the translation/rotation compared to the known technology, wherein, for example the generation and transmission of frequencies above 50 kHz into the ear is performed. Advantageously, a frequency range up to 100 kHz is used. The frequency response is favorable when frequencies above 50 kHz are generated with an amplitude that is at least half the amount of the amplitude in the frequency range below 50 kHz, i.e. below 49.99 kHz. Thus, the 3 dB cutoff frequency of the frequency response can be at 50 kHz. Thus, at a frequency response of up to 100 kHz, the 3 dB cutoff frequency would again be at 100 kHz.

As illustrated in FIG. 2*b*, the length of the earphone can be between 4 and 15 mm, depending on the intended purpose.

Figure 3:
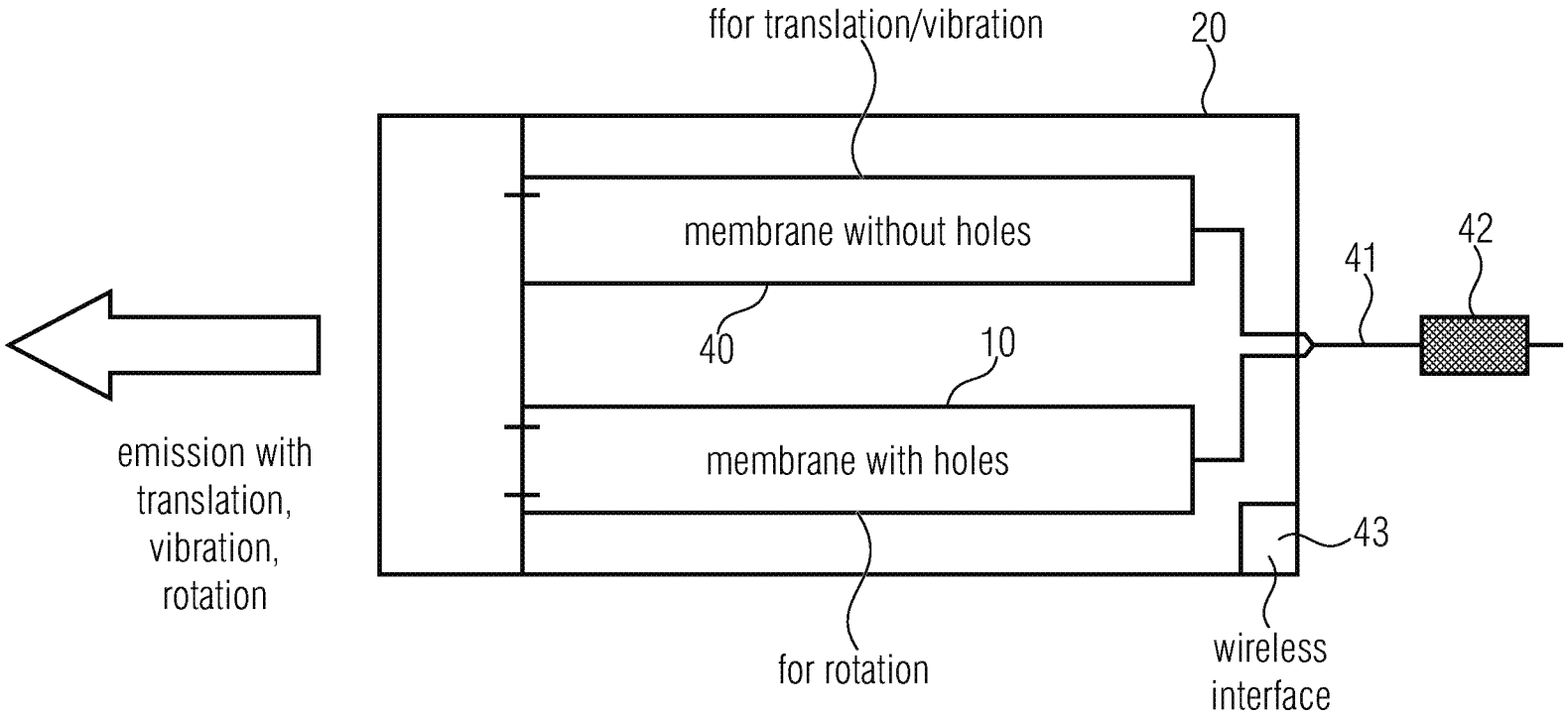
FIG. 3 shows a detailed illustration of an earphone according to a further embodiment of the present invention with two converter elements, one having a membrane with holes and another a membrane without holes.

FIG. 3 shows a schematic illustration of an alternative earphone, comprising, in addition to the membrane 10 with holes, as shown in FIG. 1*a*, 1*b*, 2*a*, a further membrane 40, for example, implemented in the same way but without or with fewer holes. Thus, there are two sound converters within the earphone which are controlled by different signals, wherein one sound converter, i.e. the "membrane with holes", provides for rotation and the second sound converter, i.e. the "membrane without holes", provides for translation and vibration. While not shown in FIG. 3, each membrane 10, 40 has its own actuator, membrane carrier and is provided with a separate signal supplied to the earphone via a cable 41 having a plug 42 or a socket or alternatively, for example, additionally via a wireless interface. Although FIG. 3 shows that the membrane 40 has no holes, improvement of translation/vibration compared to pure rotation is also obtained in that the membrane 40 has fewer holes than the membrane 10, or that the membrane holder for the membrane 40 has fewer openings than the membrane holder for the membrane 10. Both membranes with respective holder and respective actuator are arranged in the same housing 20.

Instead of the plug 42, a socket can be attached to the cable 41. In any case, the cable 41 having a plug 42 or a socket or the wireless interface 43 are implemented to provide two separate control signals for the membrane actuator 18 and the further membrane actuator for the membrane 40.

In the following, the generation of the different signals will be discussed with reference to FIG. 4.

Figure 4:
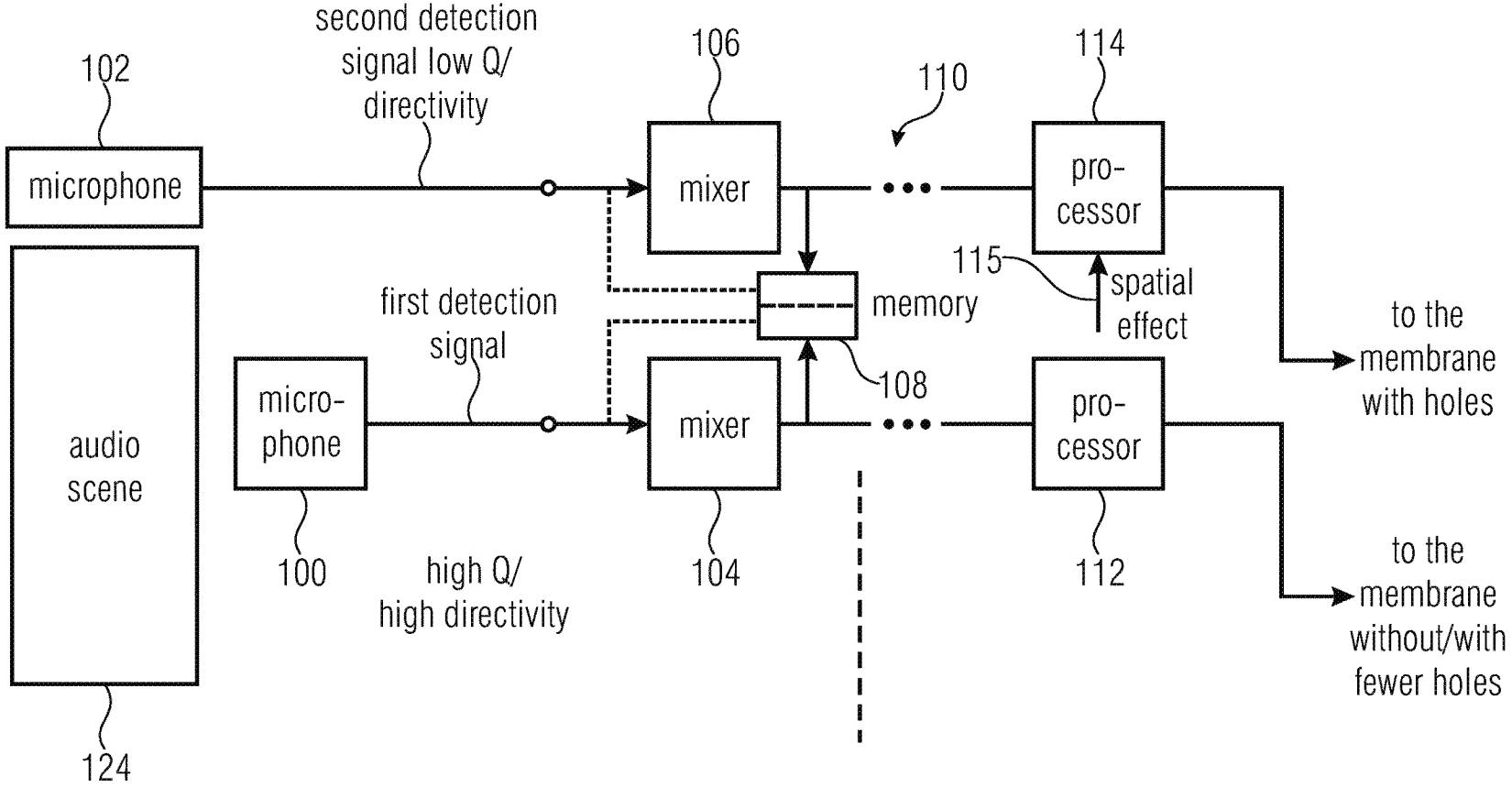
FIG. 4 shows a schematic illustration of a recording/transmission/reproduction situation for the embodiment shown in FIG. 3.
Figure 5:
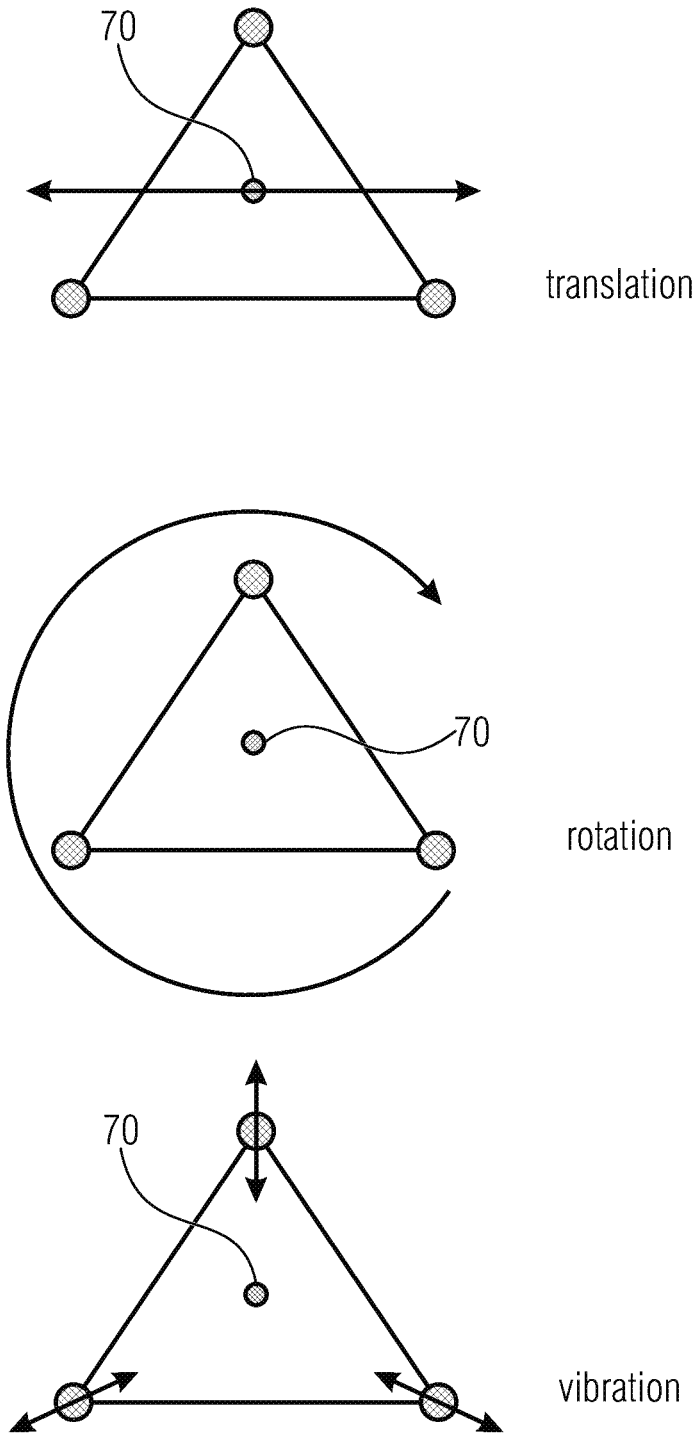
FIG. 5 shows a schematic illustration of the three components translation/rotation/vibration.

FIG. 4 shows different microphone sets 100, 102. Each microphone set 100, 102 advantageously includes a number of microphones, for example 10 or even more than 20 individual microphones. Thus, the first detection signal includes 10 or 20 or more individual microphone signals. This also applies for the second detection signal. These microphone signals are then typically mixed down within the mixers 104, 106 to obtain respectively mixed signals with a respective lower number of individual signals. When, for example, the first detection signal had 20 individual signals and the mixed signal has 5 individual signals, each mixer performs a downmix from 20 to 5. Above that, as shown in FIG. 4, a specific placement of the microphone sets 102, 100 with respect to an audio scene 124 is performed. The microphones are mainly placed above or on the side of the audio scene 124, as illustrated in 102 in order to detect the second detection signal with lower quality or lower directivity. On the other hand, the microphones of the first microphone set 100 are positioned in front of the audio scene 124 or between the audio scene 124 and a typical listener position in order to detect the directed sound energy emitted by the audio scene 124.

The mixed signals are either stored separately, as illustrated at 108, or transmitted to a reproduction system via a transmission path 110, in order to be processed by processors 112, 114, wherein these processors are, for example, amplifiers, mixers and/or binaural processors in order to provide the signal to the first sound converter with the further membrane 40 of FIG. 3, which will typically be a stereo signal with two channels, and the signal to the second sound converter with the membrane 10 of FIG. 3, which will also be a stereo signal with two channels. As illustrated in FIG. 4 at 115, the processors 112, 114 can also perform reverberation, wherein this reverberation is particularly of advantage for the rotation signal, but advantageously not for the directed signal.

Thus, the inventive earphone is implemented to generate all three transmission mechanisms translation, vibration and rotation or to transmit the same to the ear. For transmitting translation and vibration, standard sound converters having an extended high-frequency range, possibly up to 100 kHz, are of advantage. Also, several converters can be used for individual frequency ranges for transmitting the whole spectrum. For transmitting rotation, holes or openings or a separate sound converter with holes or openings are incorporated into the earphone.

In a method for producing the earphone, a membrane carrier with openings is provided. Above that, a membrane with holes is provided. The membrane and the membrane carrier are both accommodated in one housing such that the openings and holes connect the top and the bottom to each other, so that gas, such as air, can move through the openings and holes between the top and the bottom.

While above only a single converter is illustrated both for the membrane 10 of FIG. 1*b* or FIG. 3 and the membrane 40 of FIG. 3, it should be noted that also several converters can be used for individual frequency ranges for transmitting the whole spectrum, as long as they are accommodated together in the housing 20, so that the earphone is still small enough to be introduced into the ear.

Above that, it should be noted that when only a single converter element having holes exists, as illustrated in FIG. 1*b* or 1*a*, the one membrane generates both translation and vibration as well as rotation. For that purpose, the two signals for rotation and vibration/translation, as recorded and processed separately in FIG. 4, can be mixed in order to control the single converter element. If, however, as has already been illustrated, separate implementation with two different actuators is carried out as in FIG. 3, the signals will be applied separately to the individual converters.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An earphone comprising:

a membrane mounted on a membrane carrier and arranged between a top space and a bottom space;

a membrane actuator implemented to deflect the membrane in dependence on a control signal;

a housing, in which the membrane carrier, the membrane and the membrane actuator are arranged, wherein the housing comprises a sound exit, wherein the membrane carrier comprises a plurality of openings, and wherein the membrane comprises a plurality of holes, wherein the plurality of openings in the membrane carrier and the plurality of holes in the membrane connect the top space and the bottom space to each other, wherein the plurality of openings in the membrane carrier and the plurality of holes in the membrane are arranged in such a way that a first opening of the plurality of openings in the membrane carrier is placed adjacent to a first hole of the plurality of holes in the membrane and a second opening of the plurality of openings in the membrane carrier is placed adjacent to a second hole of the plurality of holes in the membrane, wherein by a cooperation between the first opening of the plurality of openings in the membrane carrier and the first hole of the plurality of holes in the membrane, a rotation of gas is generated by the deflection of the membrane in dependence on the control signal, and by a further cooperation between the second opening of the plurality of openings in the membrane carrier and the second hole of the plurality of holes in the membrane, a further rotation of gas is generated by the deflection of the membrane in dependence on the control signal, and wherein the earphone is configured to emit sound through the sound exit due to the rotation of gas and the further rotation of gas reaching the sound exit, wherein the membrane carrier is implemented to hold the membrane along a periphery of the membrane, wherein the first or the second opening of the plurality of openings in the membrane carrier is arranged between two holding portions, such that a portion of the membrane between the holding portions is not connected to the membrane carrier, wherein the first or second hole of the plurality of holes in the membrane is formed in the portion of the membrane and beside the first or second opening.

2. The earphone according to claim 1, wherein the housing comprises a top opening for connecting the top space to the sound exit and a bottom opening for connecting the bottom space to the sound exit.

3. The earphone according to claim 1, wherein the first opening or the second opening of the plurality of openings in the membrane carrier comprises a length or a diameter between 0.4 and 0.6 mm, or wherein the first hole or the second hole of the plurality of holes in the membrane comprises a length or a diameter between 0.05 and 0.15 mm.

4. The earphone according to claim 1, wherein a distance between two adjacent openings of the plurality of openings in the membrane carrier or between two adjacent holes of the plurality of holes in the membrane is between 0.4 and 0.6 mm.

5. The earphone according to claim 1, wherein the plurality of holes is arranged so that the holes of the plurality of holes are arranged evenly along the periphery of the membrane, and the plurality of openings is arranged so that the openings of the plurality of openings are arranged evenly along the periphery of the membrane carrier, wherein the plurality of holes in the membrane has at least five holes on each side of the membrane, and wherein the plurality of openings in the membrane carrier has at least two openings on each side of the membrane carrier.

6. The earphone according to claim 1, wherein at least two holes of the plurality of holes are arranged along one length of an opening between two holding portions of the membrane carrier beside first or the second the opening of the plurality of openings.

7. The earphone according to claim 1, wherein the housing is dimensioned such that the earphone can be introduced into a human auditory passage.

8. The earphone according to claim 1, wherein the membrane and the membrane actuator are implemented to generate frequencies above 50 kHz with amplitudes that are at least half the amount of amplitudes in a frequency range below 50 kHz.

9. The earphone according to claim 1, further comprising:

a further membrane arranged at a further membrane carrier, wherein the further membrane comprises fewer holes than in the plurality of holes in the membrane or no holes, and further a further membrane actuator for actuating the further membrane, wherein the further membrane carrier comprises fewer openings than in the plurality of holes in the membrane carrier or no openings, and wherein the further membrane and the further membrane carrier and the further membrane actuator are also arranged in the housing.

10. The earphone according to claim 9, further comprising:

a connecting cable comprising a plug or a socket or a wireless interface, wherein the connecting cable comprising the plug or the socket or the wireless interface is implemented to provide two separate and different control signals, wherein a first control signal of the two separate and different control signals is provided for the membrane actuator and for the membrane, and wherein a second control signal of the two separate and different control signals is provided for the further membrane actuator and for the further membrane.

* * * * *